US005653079A

United States Patent [19]

Loeffler et al.

[11] Patent Number: 5,653,079

[45] Date of Patent: Aug. 5, 1997

[54] TRUSS BRACKET

[75] Inventors: William F. Loeffler, Lakeville; A. Norris Breivik, Savage, both of Minn.

[73] Assignee: United Steel Products Company, Montgomery, Minn.

[21] Appl. No.: 576,361

[22] Filed: Dec. 21, 1995

[51] Int. Cl.[6] ..... E04C 5/00

[52] U.S. Cl. ..... 52/712; 52/715; 403/396

[58] Field of Search ..... 52/712, 715, 696, 52/690, 92.2, 93.1, 702; 403/384, 389, 391, 396

[56] References Cited

U.S. PATENT DOCUMENTS

| | | | |
|---|---|---|---|
| 4,594,017 | 6/1986 | Hills | 52/702 X |
| 4,897,979 | 2/1990 | Colonias | 52/702 X |
| 4,976,085 | 12/1990 | Krueger | 52/715 |
| 5,412,920 | 5/1995 | Hess | 52/712 |
| 5,448,871 | 9/1995 | Newman et al. | 52/712 |

FOREIGN PATENT DOCUMENTS

| | | | |
|---|---|---|---|
| 217996 | 3/1942 | Switzerland | 52/715 |

OTHER PUBLICATIONS

Catalog C-94H-1 Simpson Strong-Tie Company, Inc., copyright publication 1993, p. 63.

*Primary Examiner*—Creighton Smith
*Attorney, Agent, or Firm*—Dorsey & Whitney LLP

[57] ABSTRACT

A unitary truss clip for interconnecting adjacent truss members comprising a base, first and second top flanges extending from the base in opposite directions, first and second bottom flanges extending from the base in opposite directions and nail receiving openings in each of the top and bottom flanges.

19 Claims, 4 Drawing Sheets

TRUSS BRACKET

BACKGROUND OF THE INVENTION

1. Field of the Invention

The present invention relates generally to a truss clip or bracket and more specifically to a unitary truss clip or bracket adapted for connection with side-by-side truss members to transfer excessive load from one truss to the other.

2. Description of the Prior Art

In the construction industry generally, and in the metal plated wood floor truss industry specifically, occasions arise when either the uniform load or a concentrated load exceeds the capacity of a single truss. This requires use of a double or multiple truss by placing two or more trusses side-by-side and connecting them so that a portion of the excessive load can be transferred from one truss to the other. Several techniques and products exist for making this connection. In one, vertical wood webs are placed within a truss so that two trusses can be attached by nailing a wood block or plywood plate across the face of two aligned webs. Sometimes such connection is done at the truss plant, while other times it is done at the job site. In either case, the nailing is done in a confined area between the webs of each truss.

Reinforcing angles constructed of sheet metal are also commonly used for this purpose. Such application involves nailing one leg of a reinforcing angle to the edge of one truss member and the leg of a second reinforcing angle to the edge of a second truss. The trusses are then placed in side-by-side position and the two reinforcing angles are nailed to the tops of the adjacent trusses. One disadvantage of this mounting structure is that the reinforcing angles must be used in pairs. Further, permissible load for such connectors is limited because the load is supported entirely by nails driven into the inner edges of the truss. Still further, the outwardly extending legs of the reinforcing angles interfere with assembly (i.e., nesting) of the trusses and often require the legs to be pried into position onto the top of each adjacent truss.

Accordingly, there is a need in the art for a truss dip or bracket which is inexpensive and easy to install, which provides increased load capacity and which overcomes the limitations and disadvantages of the prior art.

SUMMARY OF THE INVENTION

In contrast to the prior art, the present invention relates to a truss clip or bracket which reduces installation time compared to conventional products, provides ease of assembly of the second truss with the first truss and requires fewer nails to achieve the same or greater load. The truss clip of the present invention is also of a single, one piece unitary construction.

More specifically, the truss dip of the present invention includes a base adapted to be positioned between a pair of adjacent truss members, a pair of first and second top flanges extending outwardly from an edge of the base at right angles in opposite directions for connection to the top surfaces of the adjacent truss members and a pair of first and second bottom flanges extending outwardly from a bottom edge of the base in opposite directions for connection with the bottom or outer edge surfaces of the adjacent truss members. In the preferred embodiment, the outermost ends of each of the bottom flanges is bendable to facilitate nailing into the outer edge of the truss member. With the truss clip of the present invention, load from one truss member is transferred from one of the bottom flanges connected with one of the truss members to a corresponding top flange connected to the adjacent truss member. Preferably the bottom flanges are longer than the top flanges. This enables the second truss member to be at least partially supported by the longer bottom flange during assembly, thereby facilitating easier nesting of such truss between the top and bottom flanges and more efficient assembly.

The invention also relates to a method of interconnecting a pair of adjacent truss members which includes providing a truss clip of the type described above, inserting one of the truss members between the first top flange and the second bottom flange and at least partially connecting the truss clip to such truss member. Then inserting the second adjacent truss member between the second top flange and a first bottom flange and completing the connection of the truss clip to the truss members.

The invention also relates to a blank for a truss clip of the type described above which is of generally rectangular configuration and has a centrally positioned base defined by a pair of parallel fold lines. The blank also includes a pair of first and second top flanges extending outwardly from one side edge of the base in which the flanges are separate from one another and are independently foldable relative to the first fold line and a pair of first and second bottom flanges extending outwardly from the other of the fold lines, the other flanges also being separate from one another and being independently foldable about such other fold line.

Accordingly, an object of the present invention is to provide a truss clip or bracket which is easy to install.

Another object of the present invention is to provide a truss clip or bracket which utilizes fewer nails then currently existing devices while carrying the same or greater load.

Another object of the present invention is to provide a unitary truss clip or bracket for supporting a pair of truss members relative to the other.

A still further object of the present invention is to provide a method of connecting adjacent truss members to one another using a truss clip or bracket of the type described above.

A still further object of the present invention is to provide a blank for a truss clip or bracket of the type described above.

These and other objects of the present invention will become apparent with reference to the drawings, the description of the deferred embodiment and the appended claims.

DESCRIPTION OF THE PREFERRED EMBODIMENT

In general, the truss dip of the present invention is designed to interconnect a pair of adjacent truss members to one another so that a load applied to one will be at least partially transferred to the other. Although the preferred embodiment illustrates the truss clip applied to a pair of truss members, certain embodiments of the truss clip of the present invention can also be utilized to interconnect more than two truss members. Further, the invention has been described in the preferred embodiment as a truss clip or alternatively as a truss bracket. Both are considered to be acceptable technology.

Figure 1:
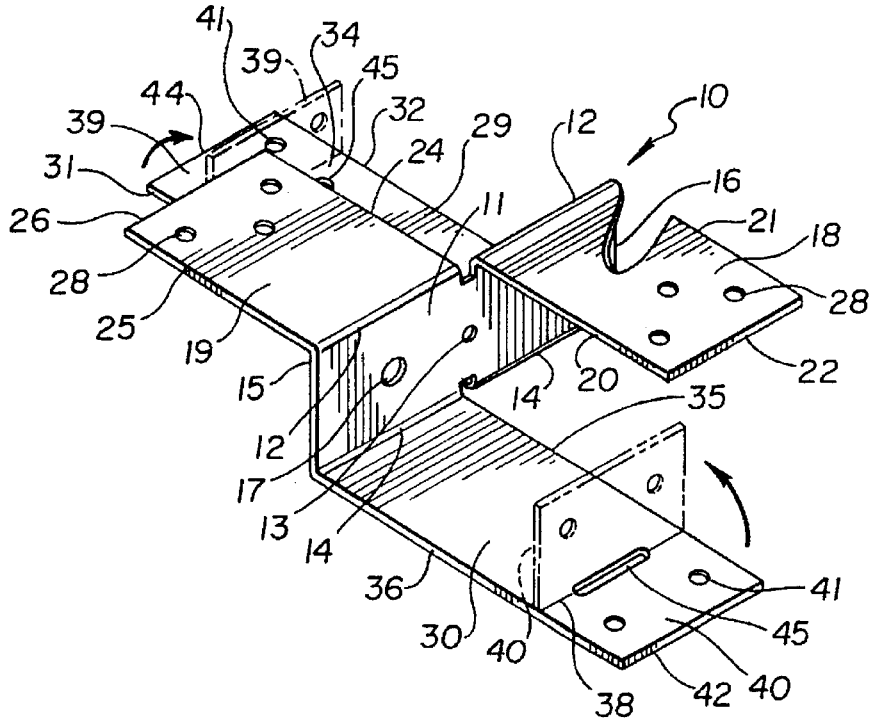
FIG. 1 is an isometric view, with a portion broken away, of the truss clip of the present invention prior to installation, with bendable ends of the bottom flanges shown in phantom.

Reference is first made to FIG. 1 showing the truss bracket 10 of the present invention prior to installation. The truss bracket 10 includes a generally a rectangular base 11, first and second top flanges 18 and 19 extending outwardly from the base 11 in opposite directions and first and second bottom flanges 29 and 30 extending outwardly from the base 11 in opposite directions. In the preferred embodiment, the clip 10 is a one piece, unitary construction constructed of 18 gauge galvanized steel although other types and weights of materials may be used as well.

The base 11 has a generally rectangular configuration with a first or top edge 12, a second or bottom edge 14 and a pair of side edges 15 and 16. Centrally positioned in the base 11 is a nail hole 13 and a pair of larger location holes 17. Both the hole 13 and the holes 17 are optional. As illustrated, the side edges 15 and 16 are free edges and do not connect with any other structure, while the top and bottom edges 12 and 14 define fold or bend lines for connection with the top flanges 18 and 19 and the bottom flanges 29 and 30, respectively.

The first top flange 18 includes a proximal edge integrally joined with and defined by a portion of the top edge 12 of the base 11, a distal or free edge 22 and a pair of side edges 20 and 21. The flange 18 has a generally rectangular, planer configuration and extends outwardly from a portion of the top edge 12 of the base 11 at generally right angels to the base 11 as shown. The outer portion of the flange includes a plurality of nail receiving openings 28.

The second top flange 19 is separate from the flange 18 and includes a proximal edge integrally joined with and defined by a portion of the top edge 12 of the base 11. The flange 19 also includes a distal or free edge 26 and a pair of side edges 24 and 25. The flange 19 has a generally rectangular planer configuration and extends outwardly from the edge 12 of the base 11 at generally right angels relative to the base 11 and in a direction opposite to that of the flange 18. Thus, although the flanges 18 and 19 lie in the same plane, they extend from the base 11 in opposite directions. The top flange 19 also includes a plurality of nail receiving openings 28.

The first bottom flange 29 includes a proximal edge integrally formed with and defined by a portion of the bottom edge 14 of the base 11, a distal or free edge 44 and a pair of side edges 31 and 32. The flange 29 has a generally rectangular configuration and extends outwardly from the bottom edge 14 of the base 11 in a direction perpendicular to the base 11 and in a direction opposite to that of the first top flange 18. Thus, the first top flange 18 and first bottom flange 29 are generally parallel to one another in different planes, and extend in opposite directions from the base 11. In the preferred embodiment, the bottom flange 29 includes a bendable truss edge connection tab 39 which is positioned near the distal edge of the flange 29 and which is defined by the fold line 34 and the fold slot 45. The tab 39 is shown in FIG. 1, in its pre-installation position by solid lines and in its post-installation bent position by broken lines.

The second bottom flange 30 is similar in construction to the first bottom flange 29 in that it has a generally rectangular configuration and includes a proximal edge integrally joined with and defined by a portion of the bottom edge 14 of the base 11, a distal or free edge 42 and a pair of side edges 35 and 36. A bendable truss edge connection tab 40 is positioned near the distal end of the bottom flange 30 and is defined by the fold line 38 and fold slot 45. The tab 40 is bendable from its pre-installation position shown in solid lines to its post-installation bent position by broken lines. The truss edge connection tabs 39 and 40 of the bottom flanges 29 and 30, respectively, are each provided with a plurality of nail receiving openings 41. These openings facilitate connection of the tabs 39 and 40 to the outer edges of adjacent truss members as shown and described below. The second bottom flange 30 and the second top flange 19 are generally parallel to one another in different planes, and extend in opposite directions from the base 11.

Thus, it can be seen that the truss clip 10 of FIG. 1 includes a first truss receiving pocket defined by the top flange 18 and the bottom flange 30 and a second truss receiving pocket defined by the top flange 19 and the bottom flange 29. In the preferred embodiment represented by FIGS. 1–5, the bottom flanges 29 and 30 are longer than their corresponding top flanges 19 and 18 to facilitate more efficient nesting and assembly.

Figure 10:
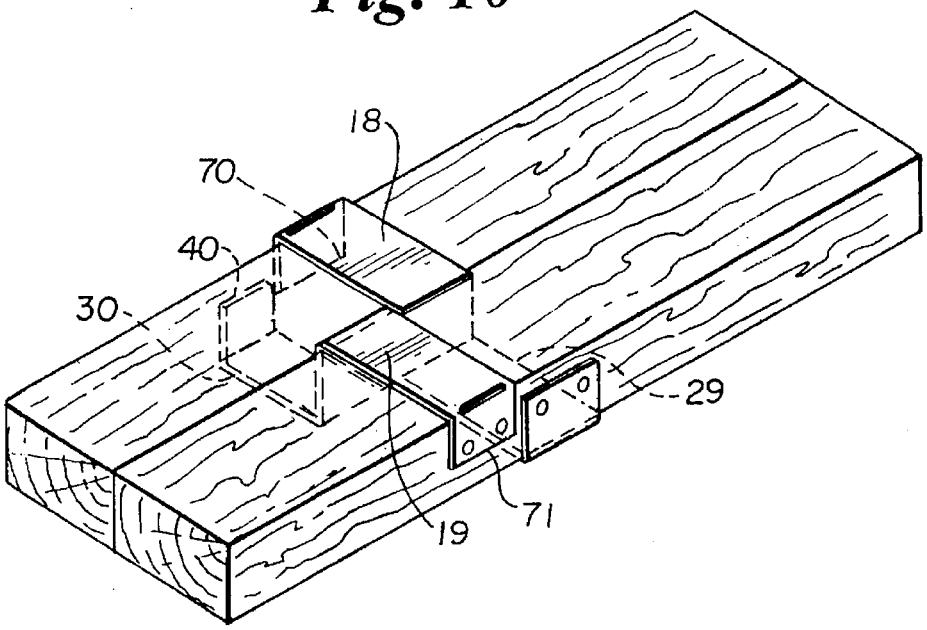
FIGS. 10, 11 and 12 are isometric views of three further embodiments of truss clips incorporating the concept of the present invention.
Figure 11:
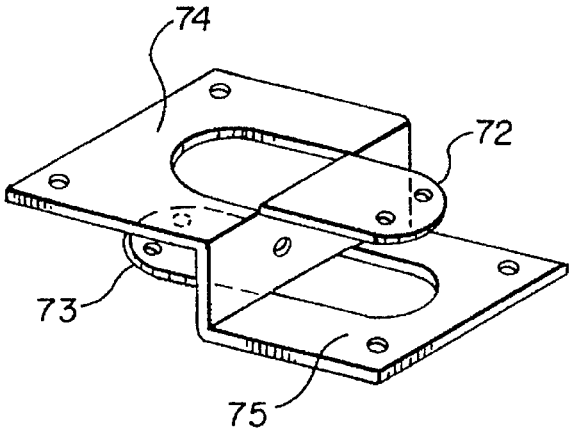
Figure 12:
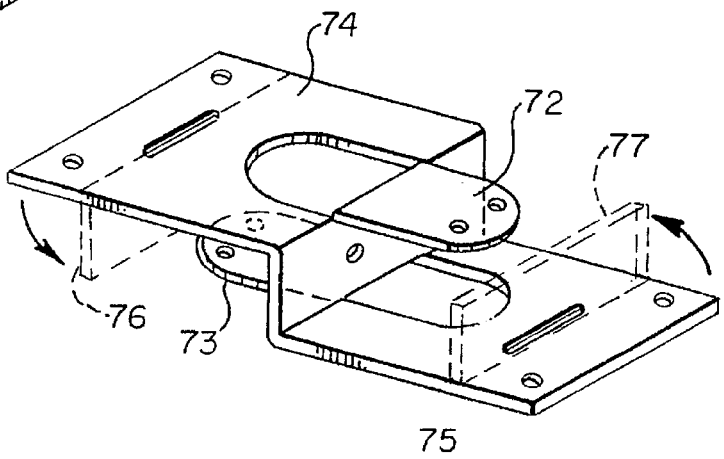

FIGS. 10, 11 and 12 represent still further embodiments of truss clips incorporating the concept of the present invention. The truss clip shown in FIG. 10 is similar to that shown in FIGS. 1–5 except that both the top 18 and 19 and bottom 29 and 30 flanges are provided with bendable connection tabs 70, 71 and 39, 40, respectively.

In FIGS. 11 and 12, one top flange 72 and one bottom flange 73 are formed as cut-outs from the other top flange 74 and the other bottom flange 75 as shown. FIG. 12 differs from FIG. 11 by providing connection tabs 76 and 77 on one of the top flanges 74 and one of the bottom flanges 75, respectively.

Figure 2:
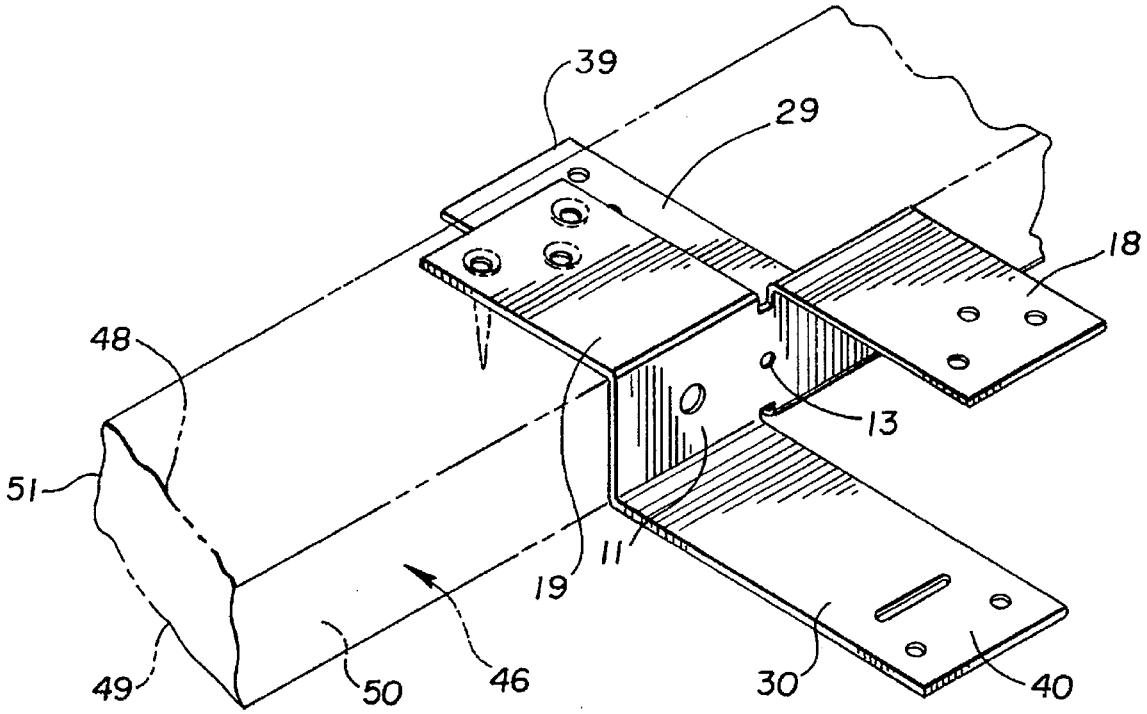
FIG. 2 is an isometric view of the truss dip of the present invention in the process of being connected to a first truss member.
Figure 3:
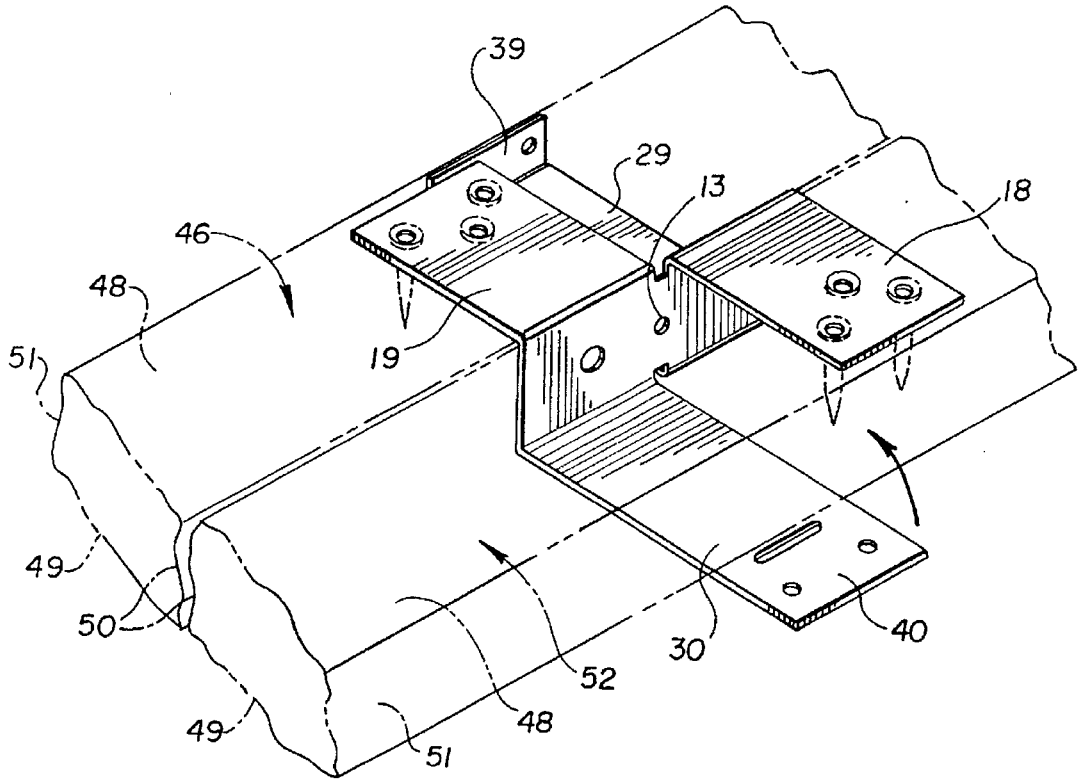
FIG. 3 is an isometric view of the truss dip of the present invention in the process of being connected with the second, adjacent truss member.
Figure 4:
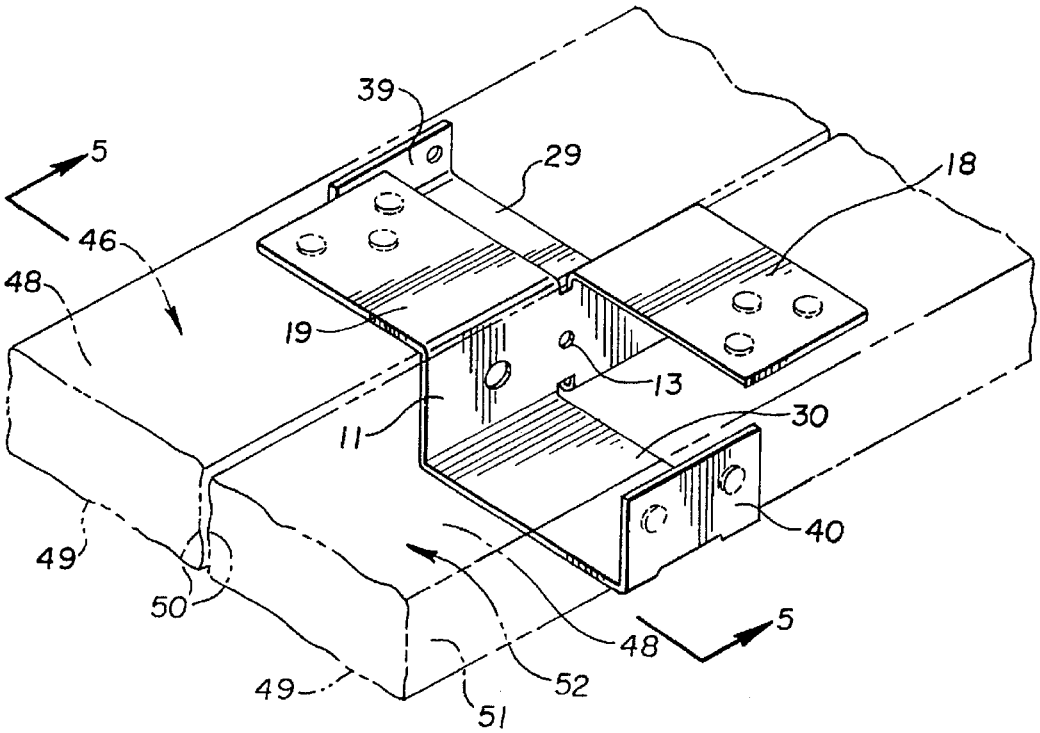
FIG. 4 is an isometric view showing the truss clip of the present invention fully connected to a pair of adjacent truss members.

Having described the structure of the preferred embodiment of the truss clip with reference to FIG. 1, the use of the bracket 10 and the method by which a pair of adjacent truss members 46 and 52 are inter-connected with such clip is shown best in FIGS. 2, 3, and 4. As shown, each of the truss members 46 and 52 includes a top surface 48, a bottom surface 49, an inner edge 50 and an outer edge 51.

First, one or more of the truss dips 10 are slid onto one of the truss members 46 at desired locations such that the truss member 46 is positioned between the second top flange 19 and the first bottom flange 29 as shown in FIG. 2. In this position, the inner edge 50 of the truss member 46 is adjacent to one side of the base 11 and the top 48 and bottom 49 surface of the truss member 46 are adjacent to the second top flange 19 and first bottom flange 29, respectively. The truss clip 10 is then at least partially connected with the truss member 46 by driving a nail into the opening 13 of the base 11, by driving one or more nails into the nail receiving openings 28 in the flange 19 or by bending the connection tab 39 upwardly above the fold line 34 and driving one or more nails through the openings 41 into the outer edge 51 of the truss member 46. In the preferred procedure, the top flange 19 is nailed into the top surface 48 of the truss member 46. This is followed by bending the connection tab 39 upwardly around the outside edge of the truss 46, with the tab 39 then being nailed to the outer edge 51 by nails through the openings 41.

After the required number of truss clips 10 are attached to the first truss 46, a second truss member 52 is slide into the opposing truss receiving pocket of the truss clips 10 between the first top flange 18 and the second bottom flange 30 as illustrated in FIG. 3. In this position the inner edge of 50 of the truss member 52 is adjacent to the inner edge 50 of the truss 46 and the opposite side of the base 11. Nailing of the clips to the truss member 52 is then completed by preferably first nailing the first top flanges 18 to the top surface 48 of the truss member 52, followed by bending the connection tab 40 upwardly around the outer edge of the truss member 52. The tab 40 is then nailed into the outer edge of 51 of the truss member 52 through the nail holes 41 as illustrated best in FIG. 4.

Figure 5:
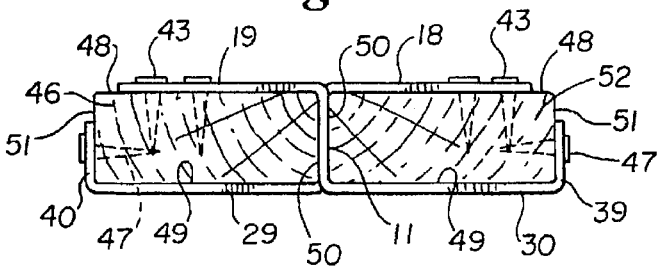
FIG. 5 is a sectional view as viewed along the section line 5—5 of FIG. 4.

FIG. 5 is a sectional view showing the bracket 10 of the preferred embodiment connected with a pair of truss members 46 and 52. As shown, when the bracket 10 is fully installed, the top flanges are connected with the top surfaces 48 of the adjacent truss members 46 and 52 by nails 43. The base 11 is positioned between the truss members 46 and 52 and the bottom flanges 29 and 30 extend along the bottom surfaces 49 of the truss members 46 and 52, with their outer connection tabs 39 and 40 bent upwardly for connection to the outer edges 51 of the truss members. The tabs 39 and 40 are connected to the edges 51 by a plurality of nails 47.

Figure 6:
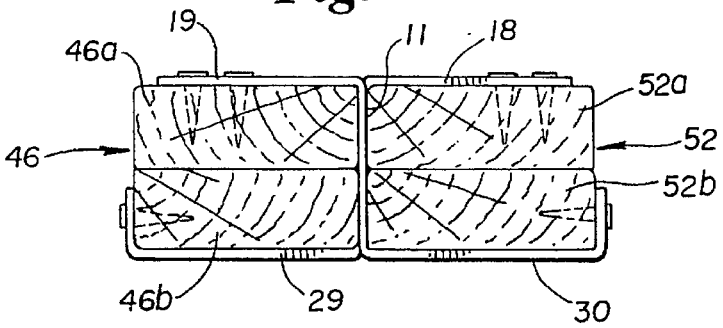
FIG. 6 is a sectional view similar to that of FIG. 5 showing an alternate embodiment of the truss clip of the present invention.
Figure 7:
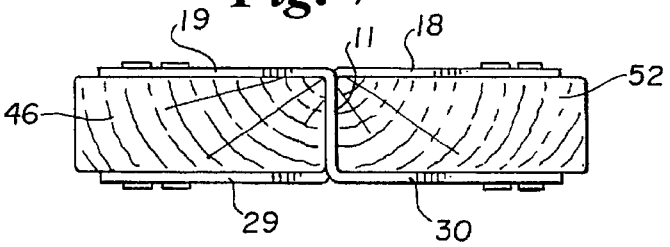
FIG. 7 is a sectional view similar to that of FIG. 5 showing a still further embodiment of the truss clip of the present invention when used with double chords of wood trusses.

FIGS. 6 and 7 are sectional views similar to FIG. 5, except that they illustrate alternate embodiments of the truss clip. More specifically, FIG. 6 shows a truss clip applied to a pair of two-ply truss members in which of the truss members 46 and 52 is comprised of a pair of truss members **46*a*, 46*b* and 52*a*, 52*b*, respectively. FIG. 7 shows a truss clip similar to that of the preferred embodiment illustrated in FIG. 5, except that the connection tabs 39 and 40** have been eliminated.

Figure 8:
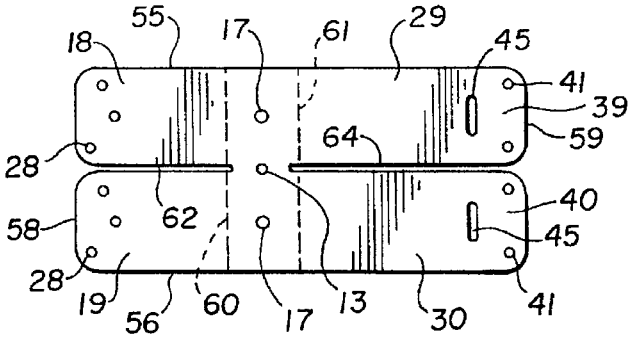
FIG. 8 is an elevational plan view of a blank of the embodiment illustrated in FIGS. 1–5.
Figure 9:
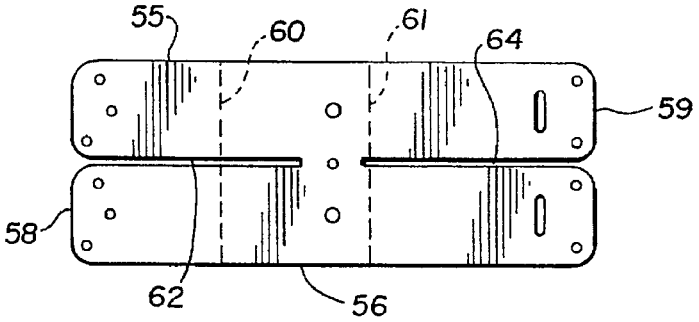
FIG. 9 is an elevational plan view of a truss clip blank for the alternate embodiment illustrated in FIG. 6.

FIGS. 8 and 9 illustrate a blank for the truss clip shown in FIG. 5 and the truss clip shown in FIG. 6, respectively. The truss clip blank illustrated in FIG. 8 is comprised of a generally rectangular, planar section of sheet metal having first and second spaced side edges 55 and 56 and first and second spaced end edges 58 and 59. In the embodiment of FIG. 8, the side edge 55 corresponds to the side edge 16 of the base 11 and the side edges 21 and 25 of the flanges 18 and 19, respectively as shown in FIG. 1. The other side edge 56 corresponds to the side edge 15 of the base 11 and the side edges 25 and 36 of the flanges 19 and 30, respectively. With respect to the end edges, the end edge 58 corresponds to the free edges 22 and 26 of the flanges 18 and 19, while the other end edge 59 corresponds to the free edges 44 and 42 of the flanges 29 and 30.

The blank of FIG. 8 also includes first and second spaced bend lines 60, 61 extending between and at right angles to the first and second side edges 55 and 56. The first and second bend lines 60 and 61 correspond to the top edge 12 and bottom edge 14 respectively of the base 11 illustrated in FIG. 1. The truss clip blank of FIG. 8 also includes a first cut 62 extending from the first end 58 to the first bend line 60 to define the pair of top flanges 18 and 19. The first cut 62 is positioned midway between the first and second edges 55 and 56 and extends at right angles to the bend line 60. The cut 62 corresponds to and defines the side edges 20 and 24 of the flanges 18 and 19.

A second cut 64 extends from the second end 59 to the second bend line 61 to define the pair of bottom flanges 29 and 30. The second cut 64 is positioned midway between the first and second edges 55 and 56 and extends at right angles to the second bend line 61. The cut 64 corresponds to and defines the side edges 31 and 35 of the flanges 29 and 30. A plurality of nail receiving openings 13, 28 and 44 are provided in the blank of FIG. 8. A pair of location holes 17 and a pair of bend slots 45, 45 are also provided as shown to define third and fourth bend lines through the flanges 29 and 30 and form the connection tabs 39 and 40.

The blank of FIG. 9 is identical to the blank of FIG. 8 except that it is longer and the bend lines 60 and 61 are spaced further from one another to accommodate a two-ply truss. Further, the first cut 62 in the blank of FIG. 9 extends past the bend line 60, although this is not necessary, whereas, in the embodiment of FIG. 8, the cut 62 terminates at the bend line 60.

Although the description of the preferred embodiment has been quite specific, it is contemplated that various changes could be made without deviating from the spirit of the present invention. Accordingly, it is intended that the scope of the present invention be dictated by the appended claims rather than by the description of the preferred embodiment.

We claim:

1. A truss clip for interconnecting adjacent truss members comprising:

a base having first and second spaced parallel edges wherein said first edge includes first and second ends and said second edge includes first and second ends corresponding to said first and second ends of said first edge;

a first top flange joined with said base along a first portion of said first edge and extending outwardly from said first edge at right angles to said base;

a second top flange joined with said base along a second portion of said first edge and extending outwardly from said first edge at right angles to said base in a direction opposite to that of said first top flange;

a first bottom flange joined with said base along a first portion of said second edge corresponding to said first portion of said first edge and extending outwardly from said second edge at right angles to said base in a direction opposite to that of said first top flange;

a second bottom flange joined with said base along a second portion of said second edge corresponding to said second portion of said first edge and extending outwardly from said second edge at right angles to said base in a direction opposite to that of said first bottom flange and in a direction opposite to that of said second top flange; and at least one nail receiving opening in each of said first and second top flanges and each of said first and second bottom flanges.

2. The truss clip of claim 1 wherein said base is substantially planar.

3. The truss clip of claim 1 wherein each of said first and second bottom flanges includes an inner connection edge connected with said base along said second edge and an outer free edge and wherein each of said first and second bottom flanges further includes a fold line between said inner connection edge and said outer free edge and parallel to said second edge.

4. The truss clip of claim 3 including an edge connecting tab comprising that portion of said first and second bottom flanges between said fold line and said outer free edge.

5. The truss clip of claim 4 including at least one nail receiving opening in each of said edge connecting tabs.

6. The truss clip of claim 1 wherein each of said bottom flanges includes an outer end and a bendable connection tab at said outer end.

7. The truss clip of claim 6 wherein each of said connection tabs includes a nail receiving opening.

8. The truss clip of claim 1 wherein each of said first and second top flanges is shorter than each of said bottom flanges as measured from said first edge and said second edge, respectively.

9. The truss clip of claim 1 including at least one nail receiving opening in said base.

10. A truss clip for interconnecting adjacent truss members comprising:

a base having first and second spaced parallel edges wherein said first edge includes first and second ends and said second edge includes first and second ends corresponding to said first and second ends of said first edge;

a first top flange joined with said base along said first edge and extending outwardly from said first edge at right angles to said base:

a second top flange joined with said base along said first edge and extending outwardly from said first edge at right angles to said base in a direction opposite to that of said first top flange;

a first bottom flange joined with said base along said second edge and extending outwardly from said second edge at right angles to said base;

a second bottom flange joined with said base along said second edge and extending outwardly from said second edge at right angles to said base in a direction opposite to that of said first bottom flange wherein said first top flange is joined with said base along said first edge at a point adjacent to said first end of said first edge, said second top flange is joined with Said base along said first edge at a point adjacent to said second end of said first edge, said first bottom flange is joined with said base along said second edge at a point adjacent to said first end of said second edge and said second bottom flange is joined with said base along said second edge at a point adjacent to said second end of said second edge and wherein said first top flange and said first bottom flange extend outwardly from said base in opposite directions and said second top flange and said second bottom flange extend outwardly from said base in opposite directions; and at least one nail receiving opening in each of said first and second top flanges and each of said first and second bottom flanges.

11. A method of interconnecting a pair of load bearing adjacent truss members, each of which includes a top surface lying in a first plane, a bottom surface lying in a second plane, an inner edge of one truss adjacent to an inner edge of another truss member and an outer edge, said method comprising the steps of:

providing a truss bracket having a base with top and bottom edges, a pair of top flanges joined with and extending from the top edge of said base in opposite directions, and a pair of bottom flanges joined with and extending from the bottom edge of said base in opposite directions whereby one of said top flanges and one of said bottom flanges form a first truss receiving pocket and another of said top flanges and another of said bottom flanges form a second truss receiving pocket, at least one of said top and bottom flanges having an outer end and a bendable connection tab at said outer end;

inserting one of said truss members into said first truss receiving pocket and at least partially retaining said truss bracket relative to said one truss member;

inserting another of said truss members into said second truss receiving pocket;

bending said connection tab at right angles to said at least one top and bottom flange;

connecting said connection tab to the outer edge of one said truss members; and connecting said one top and bottom flanges to said first truss member and connecting said other top and bottom flanges to said second truss member.

12. The method of claim 11 wherein said one top and bottom flange is said other bottom flange which is longer than said other top flange and wherein the method includes supporting said other truss member on said other bottom flange during insertion of said other truss member into said second truss receiving pocket.

13. A combination truss and truss bracket construction comprising:

a first truss member having top and bottom surfaces, inner and outer side edges, a width dimension defined by a distance between said inner and outer edges and a thickness dimension defined by a distance between said top and bottom surfaces;

a second truss member having top and bottom surfaces, inner and outer side edges, a width dimension defined by a distance between said inner and outer edges and a thickness dimension defined by a distance between said top and bottom surfaces; and a truss bracket connecting said first and second truss members together with said inner edges of said first and second truss members immediately adjacent to one another and said top surfaces of said first and second truss members lying in a common plane so that load from one of said first and second truss members is transferred to the other of said first and second truss members, said truss bracket comprising:

a base disposed between said inner edges of said first and second truss members and having first and second spaced parallel edges;

a top flange having a proximal edge joined with said base along said first edge and extending outwardly from said first edge such that said top flange is immediately adjacent to said top surface of said first truss member and being connected with said first truss member;

a bottom flange having a proximal edge joined with said base along said second edge and extending outwardly from said second edge in a direction opposite to that of said top flange such that said bottom flange is immediately adjacent to said bottom surface of said second truss member, each of said top and bottom flanges further having a distal edge spaced from its respective proximal edge and a length dimension defined by a distance between its respective proximal and distal edges, wherein the length dimension of at least one of said top and bottom flanges approximates the width dimension of the first and second truss member to which said one flange is immediately adjacent; and a connecting tab joined with the distal edge of said one flange and extending from said distal edge at right angles, said connecting tab further being immediately adjacent to and connected with the outer edge of said truss member to which said one flange is immediately adjacent.

14. The combination of clam 13 wherein said one flange is the bottom flange.

15. The combination of claim 14 including means for connecting said connecting tab to said outer edge of said second truss member.

16. The combination of claim 13 wherein said bottom flange is free of connection means.

17. The combination of claim 13 including means for connecting said top flange to said top surface of said first truss member.

18. The combination of claim 17 wherein said means includes a plurality of nail holes.

19. The combination of claim 14 wherein said connecting tab is a first connecting tab, said combination further including a second connecting tab joined with said distal edge of said top flange and extending therefrom at right angles, said second connecting tabs further being immediately adjacent to and connected with said outer edge of said first truss member.

* * * * *

UNITED STATES PATENT AND TRADEMARK OFFICE

CERTIFICATE OF CORRECTION

PATENT NO. : 5,653,079
DATED : August 5, 1997
INVENTOR(S) : Loeffler et al.

It is certified that error appears in the above-identified patent and that said Letters Patent is hereby corrected as shown below:

Column 1, Line 39 reads "dip" but should read --clip--.

Column 1, Line 53 reads "dip" but should read --clip--.

Column 2, Line 51 reads "dip" but should read --clip--.

Column 2, Line 53 reads "dip" but should read --clip--.

Column 3, Line 11 reads "dip" but should read --clip--.

Column 4, Line 58 reads "dips" but should read --clips--.

Signed and Sealed this

Twenty-eighth Day of April, 1998

Bruce Lehman

*Attest:*

BRUCE LEHMAN

*Attesting Officer*

*Commissioner of Patents and Trademarks*